US010544633B2

(12) United States Patent
Huchon

(10) Patent No.: US 10,544,633 B2
(45) Date of Patent: Jan. 28, 2020

(54) MOVEABLE HOISTING SYSTEM

(71) Applicant: CAMERON INTERNATIONAL CORPORATION, Houston, TX (US)

(72) Inventor: Jean-Philippe Huchon, Kristiansand (NO)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 371 days.

(21) Appl. No.: 15/370,921

(22) Filed: Dec. 6, 2016

(65) Prior Publication Data

US 2017/0159378 A1 Jun. 8, 2017

Related U.S. Application Data

(60) Provisional application No. 62/263,736, filed on Dec. 6, 2015.

(51) Int. Cl.

| | |
|---|---|
| ***E21B 19/00*** | (2006.01) |
| ***E21B 19/084*** | (2006.01) |
| ***E21B 15/00*** | (2006.01) |

(52) U.S. Cl.

CPC ..... *E21B 19/008* (2013.01); *E21B 15/00* (2013.01); *E21B 19/084* (2013.01)

(58) Field of Classification Search

CPC ..... B66D 1/38; E21B 19/008; E21B 19/084; E21B 15/00; E21B 19/02

See application file for complete search history.

(56) References Cited

U.S. PATENT DOCUMENTS

| | | | | |
|---|---|---|---|---|
| 2,187,392 A * | 1/1940 | Chappell | E21B 15/00 212/71 |
| 4,390,162 A | 6/1983 | Woolslayer | |
| 4,423,994 A * | 1/1984 | Schefers | E21B 19/02 166/178 |
| 4,455,013 A | 6/1984 | Fischer | |
| 4,836,300 A * | 6/1989 | Reed | E21B 19/02 175/57 |
| 5,421,468 A | 6/1995 | Wright | |
| 5,762,279 A | 6/1998 | Horton, III | |
| 7,628,225 B2 | 12/2009 | Petersson et al. | |

(Continued)

FOREIGN PATENT DOCUMENTS

| | | |
|---|---|---|
| EP | 0351557 B1 | 5/1992 |
| WO | 2015169737 A1 | 11/2015 |

OTHER PUBLICATIONS

International Preliminary Report on Patentability for the equivalent International patent application PCT/US2016/065191 dated Jun. 12, 2018.

(Continued)

*Primary Examiner* — Sang K Kim
*Assistant Examiner* — Nathaniel L Adams
(74) *Attorney, Agent, or Firm* — Helene Raybaud

(57) ABSTRACT

A hoisting system is disclosed including a moveable sheave coupled to a well support structure, the moveable sheave slideable along the well support structure and relative to a fixed sheave to laterally move a hoisting line relative to a well center. The hoisting system may include a second moveable sheave such that a second hoisting line may be laterally moved to various locations including a second well center or the same well center as the first hoisting line.

20 Claims, 9 Drawing Sheets

(56) References Cited

U.S. PATENT DOCUMENTS

| | | | | |
|---|---|---|---|---|
| 2014/0259987 | A1 | 9/2014 | Suksumake | |
| 2016/0348448 | A1* | 12/2016 | Miller, Jr. | E21B 19/084 |

OTHER PUBLICATIONS

International Search Report and Written Opinion dated Mar. 20, 2017, for International Application No. PCT/US2016/065191.
Extended Search and Examination Report R. 62 issued in European Patent application 16873685.8 dated Jul. 9, 2019, 8 pages.

* cited by examiner

MOVEABLE HOISTING SYSTEM

CROSS-REFERENCE TO RELATED APPLICATIONS

This application claims the benefit of U.S. provisional patent application No. 62/263,736 filed Dec. 6, 2015, entitled "Moveable Hoisting System" which is incorporated herein by reference in its entirety.

STATEMENT REGARDING FEDERALLY SPONSORED RESEARCH OR DEVELOPMENT

Not applicable.

BACKGROUND

Drilling platforms are used to support equipment for drilling a well or borehole to a subterranean resource, such as oil or gas. The drilling platform may be onshore or offshore depending on the location of the desired subterranean resource. The drilling platform may include a derrick, tower, or other equipment support structure. A hoisting system may be coupled to the derrick and used for raising and lowering equipment, such as tubulars, drill strings, work strings, tools, drill bits, blowout preventers and other drilling and well components. Referring to FIG. 1, a drilling or well system 10 includes a floating vessel 12. In some embodiments, the floating vessel 12 is a drillship, a semi-submersible, or other floating structure. In other embodiments, the drilling system 10 is onshore or land based and the structure 12 may include pillars, columns, or other support members coupled to the ground. The drilling system 10 includes a derrick 14 constructed on a drill floor 26 of the vessel 12. In some embodiments, the derrick 14 is a tower or other drilling support structure. The drilling system 10 also includes a hoisting system 30 that interacts with the derrick 14 to raise and lower equipment with respect to the drill floor 26, which facilitates well drilling and completion operations.

The hoisting system 30 supports a drill string 18, which is suspended from a top drive 16 or other type of lifting device. The top drive 16 is coupled to a hoisting line (or lines) 20. The hoisting line 20 is passed over a sheave or sheaves in a crown block 24. The hoisting line is coupled to a rotatable drum in a drawworks 22 located on the drill floor 26 with the derrick 14. In some embodiment, the drawworks 22 includes or is replaced with other types of hoisting devices, such as a cylinder driven hoisting system. The drawworks 22 can reel in and reel out the hoisting line 20 over the rotatable sheave in the crown block 24 such that the top drive 16 and the drill string 18 are raised and lowered along a well center WC.

SUMMARY

In some embodiments, a drilling structure includes a hoisting system with one or more moveable sheaves. In some embodiments, the system includes a well support structure, a hoisting machine including a hoisting line, a fixed sheave coupled to the well support structure, and a moveable sheave coupled to the well support structure, the moveable sheave slideable along the well support structure and relative to the fixed sheave to laterally move the hoisting line relative to a well center. In some embodiments, the system further includes a second hoisting machine including a second hoisting line, a second fixed sheave coupled to the well support structure, and a second moveable sheave coupled to the well support structure, the second moveable sheave slideable on the well support structure and relative to the second fixed sheave to laterally move the second hoisting line relative to a second well center. In some embodiments, the system further includes a second hoisting machine including a second hoisting line and a second fixed sheave coupled to the well support structure to move the second hoisting line up and down over a second well center from a fixed position. The system may include a cantilevered well support structure configured to position the hoisting line external to the well support structure and over the well center.

In some embodiments, the first and second moveable sheaves are moveable to position the hoisting line over the well center while the second hoisting line is positioned over the second well center. In some embodiments, the first and second moveable sheaves are moveable to position the hoisting line over the well center while the second hoisting line is positioned over the well center. In some embodiments, the first and second moveable sheaves are moveable to position the hoisting line over the second well center while the second hoisting line is positioned over the second well center. In some embodiments, the system further includes a track coupled between the well support structure and the moveable sheave and a drive mechanism to drive the moveable sheave along the track.

In some embodiments, a method of moving a hoisting line includes disposing a hoisting machine adjacent a well support structure, passing a hoisting line from the hoisting machine over a fixed sheave coupled to the well support structure and over a moveable sheave coupled to the well support structure, and sliding the moveable sheave along the well support structure to laterally move the hoisting line relative to the fixed sheave and a well center. In some embodiments, the method further includes engaging the hoisting machine to axially move the hoisting line over the fixed sheave and the moveable sheave. In some embodiments, the method includes disposing a second hoisting machine adjacent the well support structure, passing a second hoisting line from the second hoisting machine over a second fixed sheave coupled to the well support structure and over a second moveable sheave coupled to the well support structure, and sliding the second moveable sheave along the well support structure to laterally move the second hoisting line relative to the second fixed sheave and a second well center. In some embodiments, the method further includes sliding the first moveable sheave to position the first hoisting line over the first well center, and sliding the second moveable sheave to position the second hoisting line over the second well center while the first hoisting line is positioned over the first well center. In some embodiments, the method further includes sliding the first moveable sheave to position the first hoisting line over the first well center, and sliding the second moveable sheave to position the second hoisting line over the first well center while the first hoisting line is positioned over the first well center. In some embodiments, the method further includes sliding the first moveable sheave to position the first hoisting line over the second well center, and sliding the second moveable sheave to position the second hoisting line over the second well center while the first hoisting line is positioned over the second well center.

BRIEF DESCRIPTION OF THE DRAWINGS

For a detailed description of exemplary embodiments, reference will now be made to the accompanying drawings in which.

DETAILED DESCRIPTION

Figure 1:
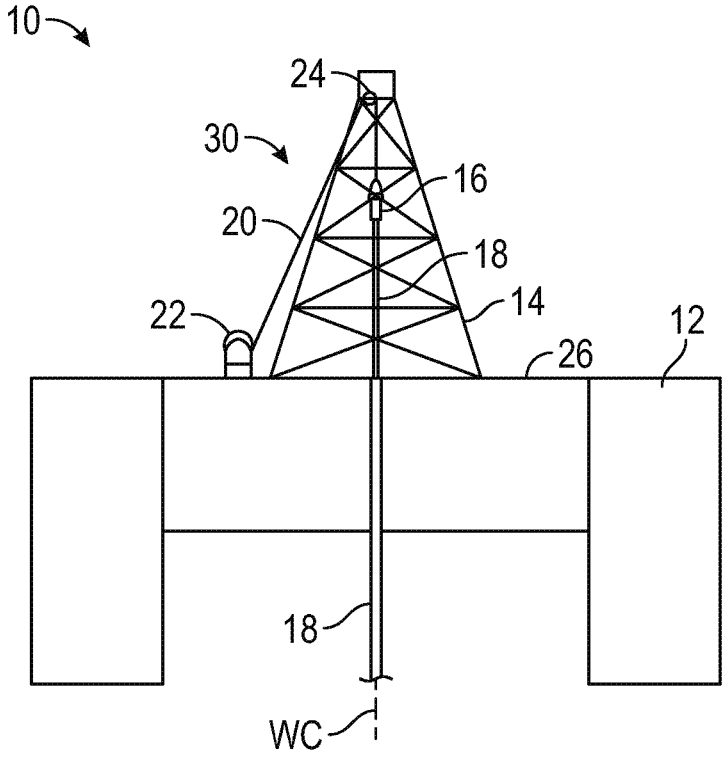
FIG. 1 (PRIOR ART)
FIG. 1 is a schematic view of a drilling or well system.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
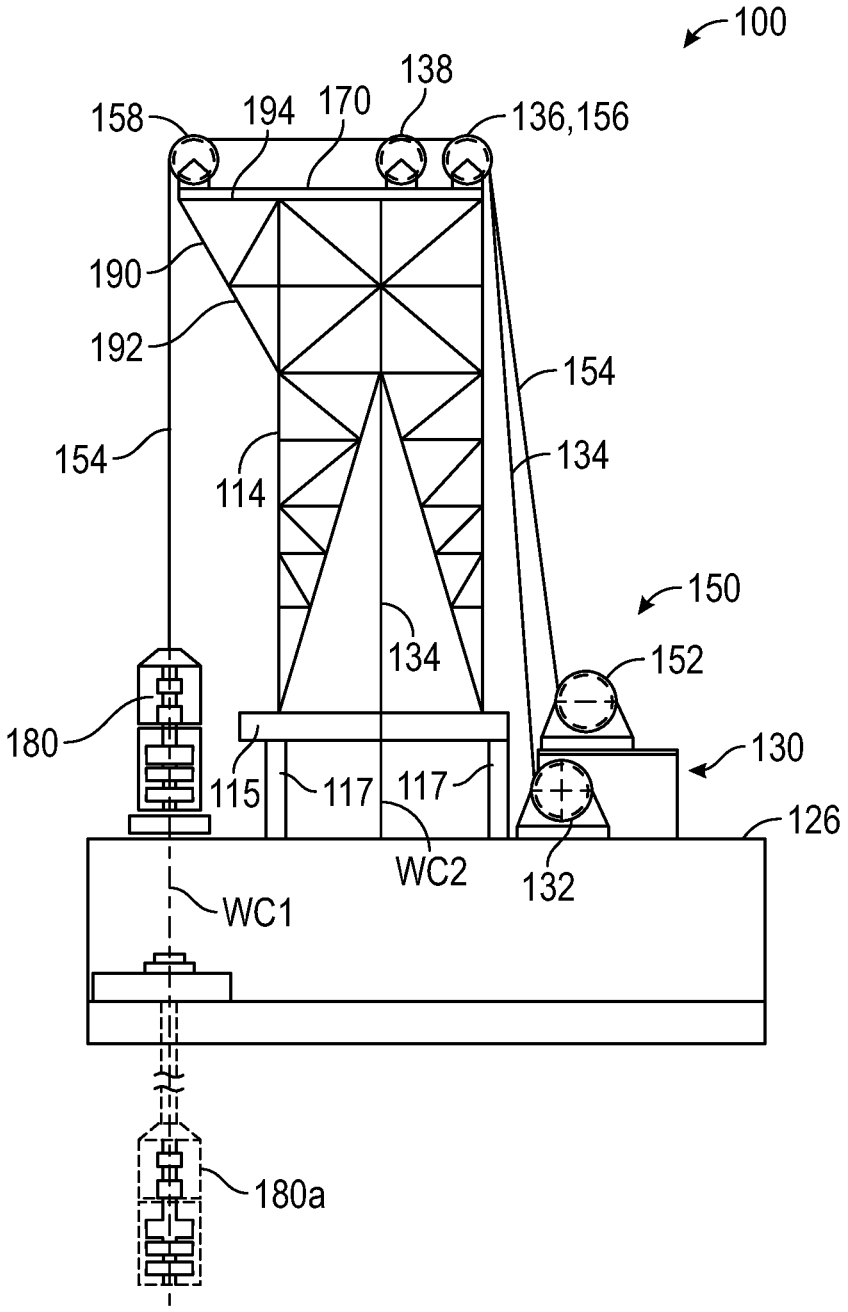
FIG. 2 is a schematic view of an embodiment of moveable hoisting systems in accordance with principles disclosed herein, wherein the hoisting systems are positioned over separate well centers.

FIG. 2 is a schematic diagram showing an embodiment of a drilling or well system 100. As noted above, the drilling or well system 100 can be configured for land or offshore, though the system will be referred to herein as an offshore drilling system for simplicity. The drilling system 100 includes a drill floor 126 and a derrick 114. As also noted above, the derrick 114 can be a tower or other well or drilling support structure but will be referenced as a derrick herein for simplicity. The derrick 114 includes a derrick platform 115 having support members 117.

The drilling system 100 also includes a first hoisting system 130 and a second hoisting system 150, which may together be referred to as a hoisting system assembly or dual hoisting assembly. The first hoisting system 130 includes a first hoisting machine 132, such as a drawworks, winches, or a cylinder system, operably coupled to a first hoisting line or lines 134. The hoisting line 134 passes over a first fixed sheave or set of sheaves 136. In some embodiments, a "fixed" sheave is one that is mounted to the derrick such that it cannot move relative to the derrick 114. The hoisting line 134 also passes over a first moveable sheave or set of sheaves 138 and extends downward through the derrick platform 115 and the drill floor 126 along a well center WC2. The moveable sheave 138 is moveably coupled to a track 170 such that it can move or slide along the track 170. In various embodiments, a drive mechanism is coupled to the moveable sheave 138 to drive the moveable sheave 138 along the track 170. In some embodiments, the moveable sheave 138 includes a motor and rollers such that it can be driven along the track 170. In some embodiments, the track 170 includes a screw drive to move or slide the sheave 138. In some embodiments, the track 170 includes a rack and pinion to move or slide the sheave 138. In some embodiments, the track 170 includes a motor, a trolley, and a push/pull cable to move or slide the sheave 138. Consequently, the sheave 138 is moveable or slideable along the derrick 114 structure.

The second hoisting system 150 includes a second hoisting machine 152, such as a drawworks, winches, or cylinder system, operably coupled to a second hoisting line or lines 154. The hoisting line 154 passes over a second fixed sheave or set of sheaves 156. The hoisting line 154 also passes over a second moveable sheave or set of sheaves 158 and extends downward along a well center WC1. The moveable sheave 158, like the moveable sheave 138, is moveably coupled to the track 170 or another track similar to the track 170. The derrick 114 includes a cantilevered extension 190 having a side extension member 194 and an angled support member 192. Consequently, the hoisting line 154 passes over the moveable sheave 158 toward the well center WC1 at a location outside of or external to the derrick 114. In some embodiments, drilling or well equipment 180 is coupled at the end of the hosting line 154, and can be lowered to a position at 180*a*.

Figure 3:
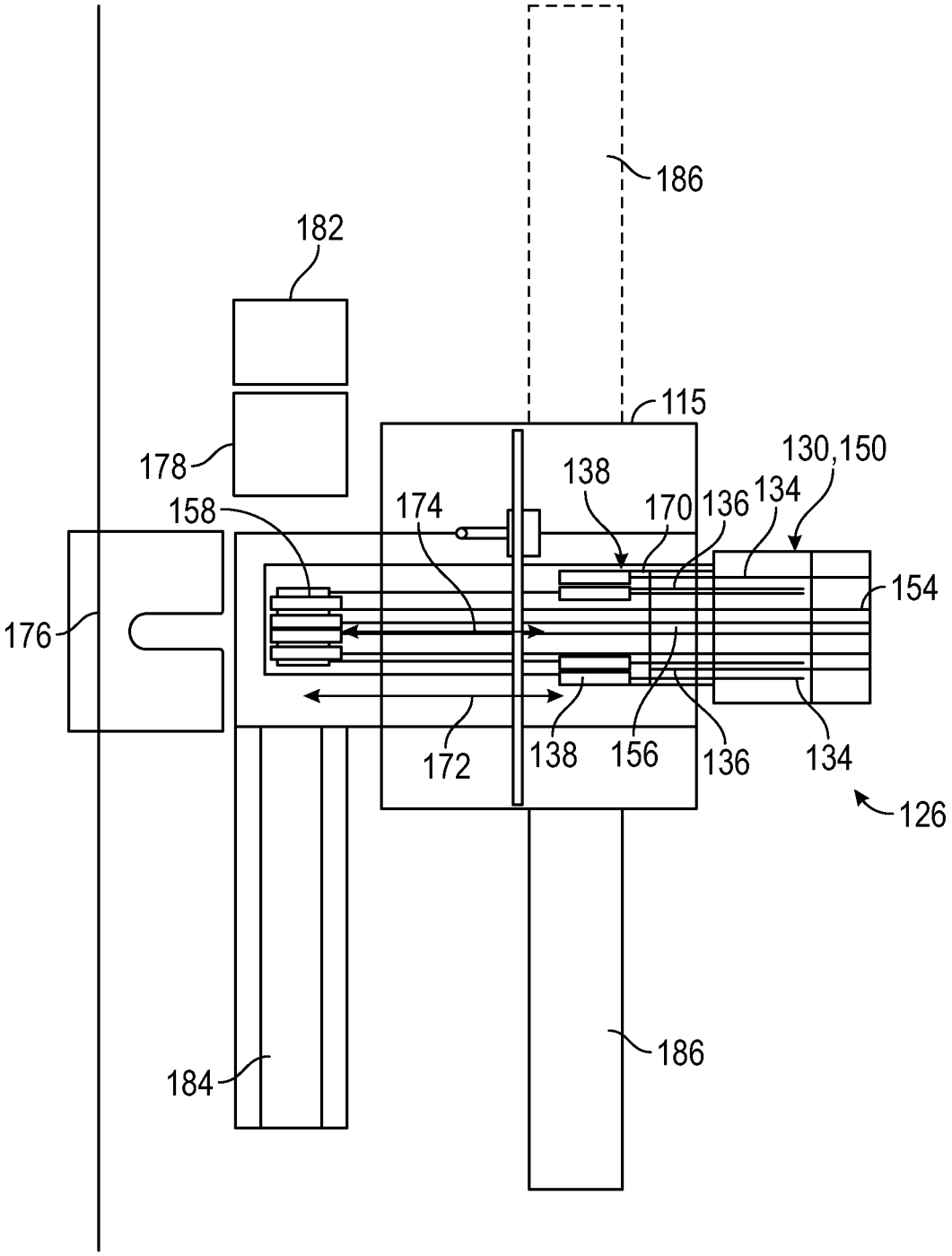
FIG. 3 is a top down view of the moveable hoisting systems of FIG. 2.

Referring to FIG. 3, a top down view of the drilling system of FIG. 2 is shown. The dual hoisting assembly 130, 150 is operably coupled to the first hoisting lines 134 that pass over the first set of fixed sheaves 136 and couple to the first set of moveable sheaves 138. The first sheaves 138 are moveable or slideable along the track 170 in the back and forth directions of arrow 172. The dual hoisting assembly 130, 150 is also operably coupled to the second hoisting lines 154 that pass over the second set of fixed sheaves 156 and couple to the second set of moveable sheaves 158. The second sheaves 158 are moveable or slideable along the track 170 in the back and forth directions of arrow 174. In some embodiments, other rig equipment may be disposed on or adjacent the drill floor 126 and derrick platform 115. For example, the drilling or well system 100 can include a hatch 176 for riser and/or blowout preventer deployment, a lower riser marine package 178, a lower blowout preventer 182, a riser catwalk 184, a combicat 186, and other well and rig equipment.

Figure 4:
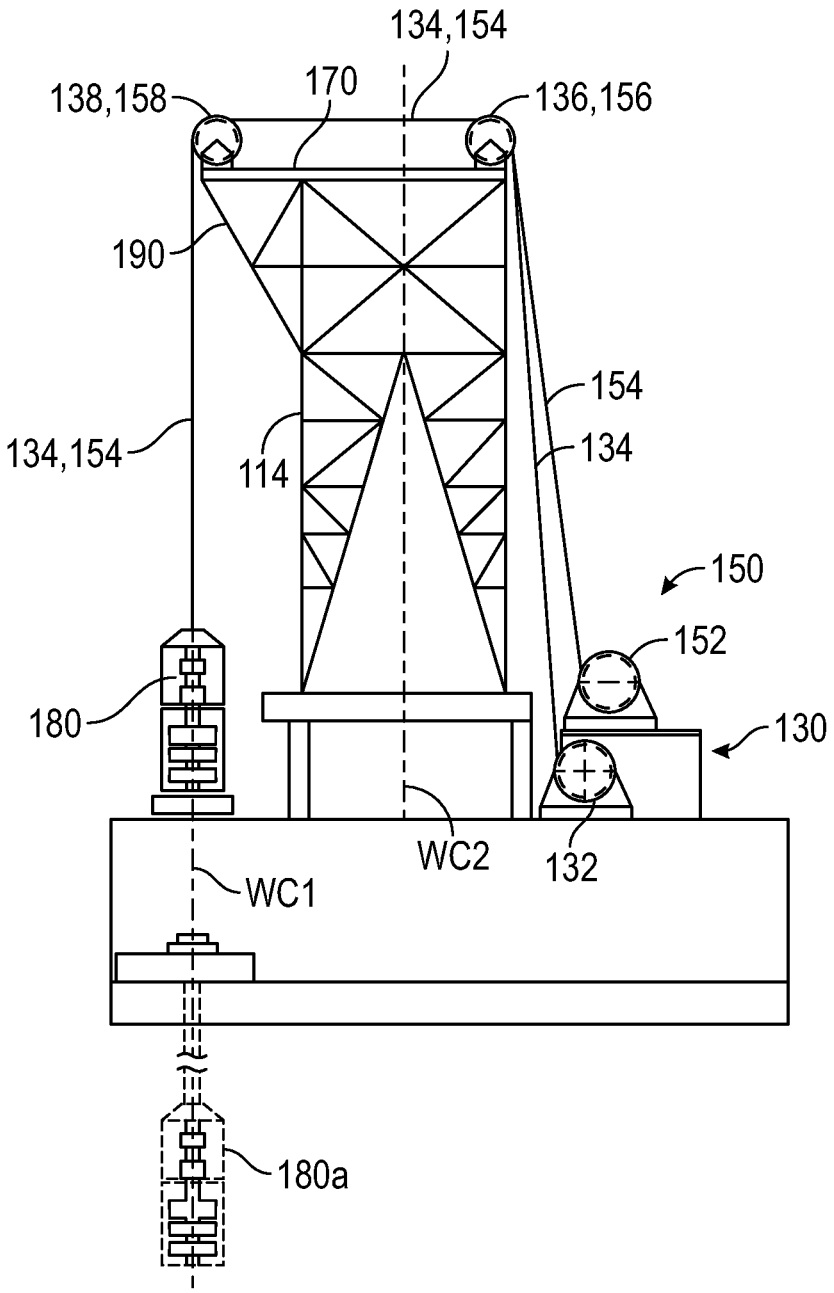
FIG. 4 is the moveable hoisting system of FIG. 2 wherein the hoisting systems are positioned over the same first well center.

Referring now to FIG. 4, the first moveable sheave 138 is moved along the track 170 from the position shown in FIG. 2 to a position adjacent the second moveable sheave 158. In this manner, the sheave 138 and the corresponding hoisting line 134 are moved laterally relative to the fixed sheave 136 and relative to the well centers WC1, WC2. Also in this manner, both hoisting lines 134, 154 can be positioned over the well center WC1 and coupled to the equipment 180 over the well center WC1 to increase the overall hoisting capacity of the system 100 by the addition of the first hoisting system 130 to the second hoisting system 150.

Figure 5:
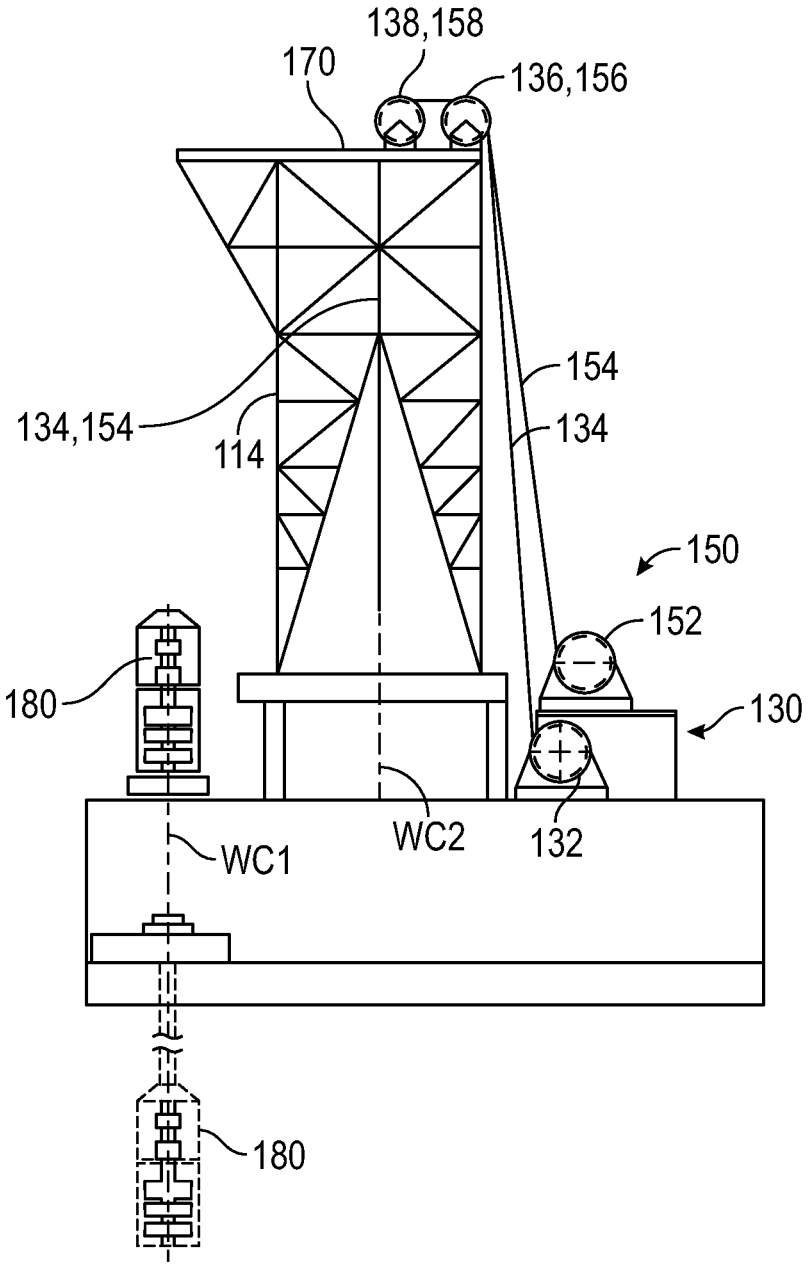
FIG. 5 is the moveable hoisting system of FIG. 2 wherein the hoisting systems are positioned over the same second well center.

Referring now to FIG. 5, the second moveable sheave 158 is moved along the track 170 from the position shown in FIG. 2 to a position adjacent the first moveable sheave 138. Or, in other embodiments, both of the moveable sheaves 138, 158 are moved from the positions of FIG. 4 to the positions of FIG. 5. Again, the moveable sheaves 138, 158 are moved laterally relative to the fixed sheaves 136, 156 and relative to the well centers WC1, WC2. In these manners, both hoisting lines 134, 154 can be coupled to the equipment 180 over the well center WC2 to increase the overall hoisting capacity of the system 100 by the addition of the second hoisting system 150 to the first hoisting system 130.

Thus, using the drilling system 100, two hoisting systems 130, 150, or the dual hoisting assembly, can be used over respective well centers WC2, WC1 simultaneously, or the two hoisting systems 130, 150 can be doubled up over the same well center to increase the hoisting capacity on well equipment 180 as shown in FIGS. 4 and 5.

It is understood that in other embodiments, the drilling system 100 includes a single hoisting system 130 or 150, with a single moveable sheave or set of sheaves 136 or 156. In such embodiments, either the hoisting system 130 or the hoisting system 150 is configured to move its respective moveable sheave 138, 158 to either well center WC1, WC2. In further embodiments, the drilling system 100 includes more than two hoisting systems for moving more than two moveable sheaves or set of sheaves to various positions over two or more well centers.

Figure 6:
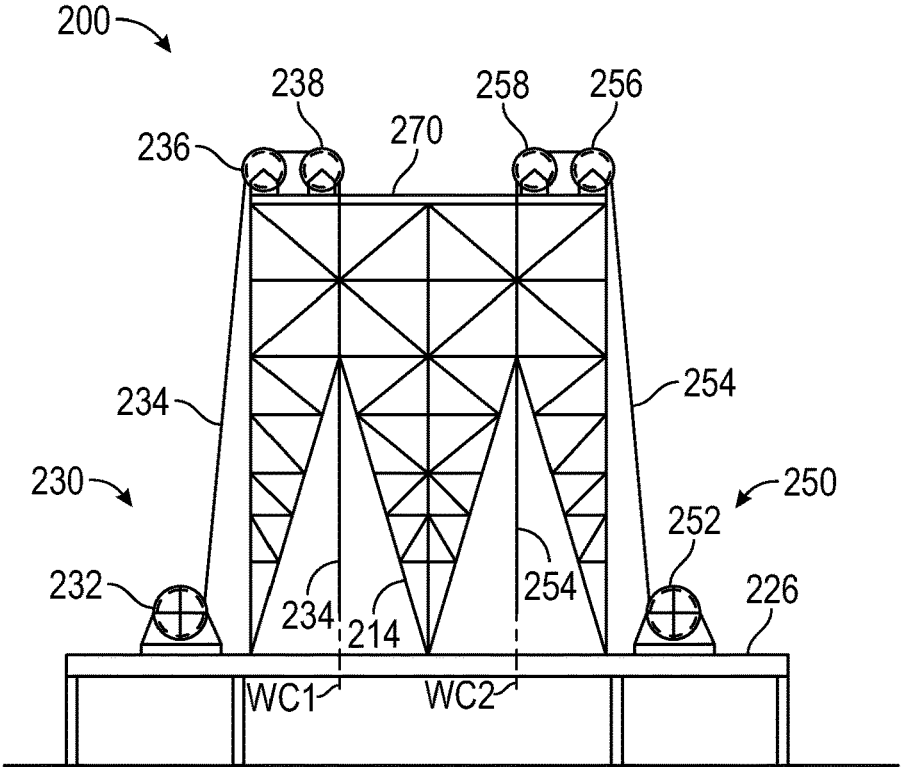
FIG. 6 is a schematic view of another embodiment of moveable hoisting systems in accordance with principles disclosed herein, wherein the hoisting systems are positioned over separate well centers.

Referring next to FIG. 6, a drilling system 200 includes a derrick 214, a first hoisting system 230, and a second hoisting system 250. The first and second hoisting systems 230, 250 may also be together referred to as a dual hoisting assembly. The first hoisting system 230 includes a first hoisting machine 232, such as a drawworks, winches, or a cylinder system, operably coupled to a first hoisting line 234. The hoisting line 234 passes over a first fixed sheave or set of sheaves 236. The hoisting line 234 also passes over a first moveable sheave or set of sheaves 238 and extends downward through the derrick 214 and a drill floor 226 along the well center WC1. The moveable sheave 238 is moveably or slideably coupled to a track 270 such that it can move along the track 270. Various mechanisms can be included with the track 270 to move the sheave 238 as discussed above with respect to the track 170.

The second hoisting system 250 includes a second hoisting machine 252, such as a drawworks, winches, or cylinder system, operably coupled to a second hoisting line 254. The hoisting line 254 passes over a second fixed sheave or set of sheaves 256. The hoisting line 254 also passes over a second moveable sheave or set of sheaves 258 and extends downward along a well center WC2. The moveable sheave 258, like the moveable sheave 238, is moveably coupled to the track 270 or another track similar to the track 270. Unlike the cantilevered derrick 114, the derrick 214 includes a double or dual derrick structure wherein the main derrick form is repeated over both well centers WC1, WC2. Consequently, both hoisting lines 234, 254 pass through or extend internally to the derrick 214. In some embodiments, well equipment similar to well equipment 180 is coupled at the end of one or both of the hosting lines 234, 254 for raising and lowering such equipment.

Figure 7:
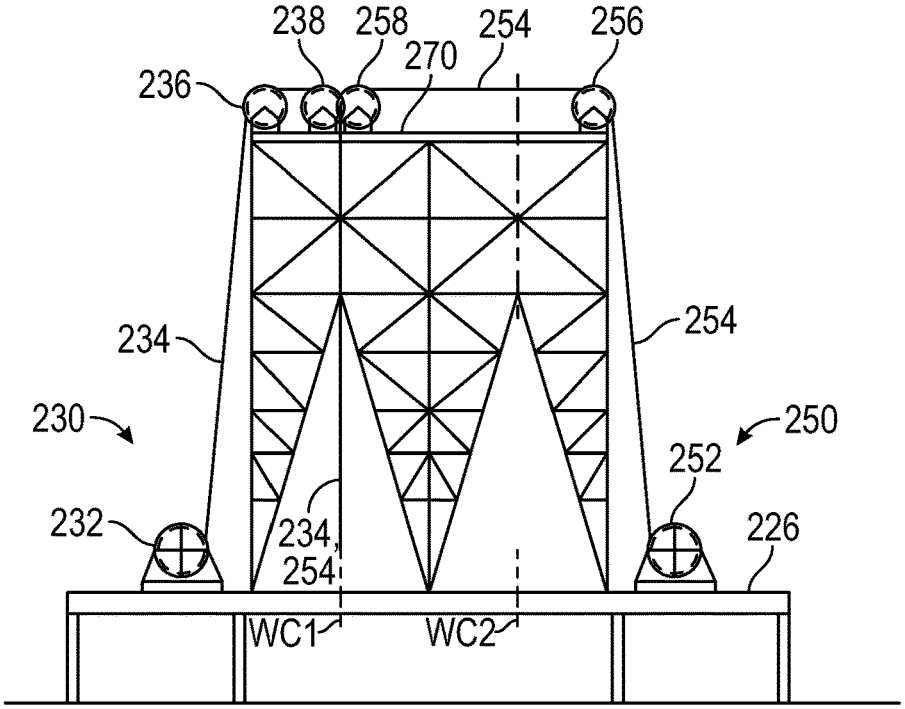
FIG. 7 is the moveable hoisting system of FIG. 6 wherein the hoisting systems are positioned over the same first well center.

Referring next to FIG. 7, the second moveable sheave 258 is moved along the track 270 from the position shown in FIG. 6 to a position adjacent the first moveable sheave 238. The sheave 258 is thus moved laterally relative to the fixed sheaves 236, 256 and the well centers WC1, WC2. In this manner, both hoisting lines 234, 254 can be coupled to the equipment 180 over the well center WC1 to increase the overall hoisting capacity of the system 200 by the addition of the second hoisting system 250 to the first hoisting system 230.

Figure 8:
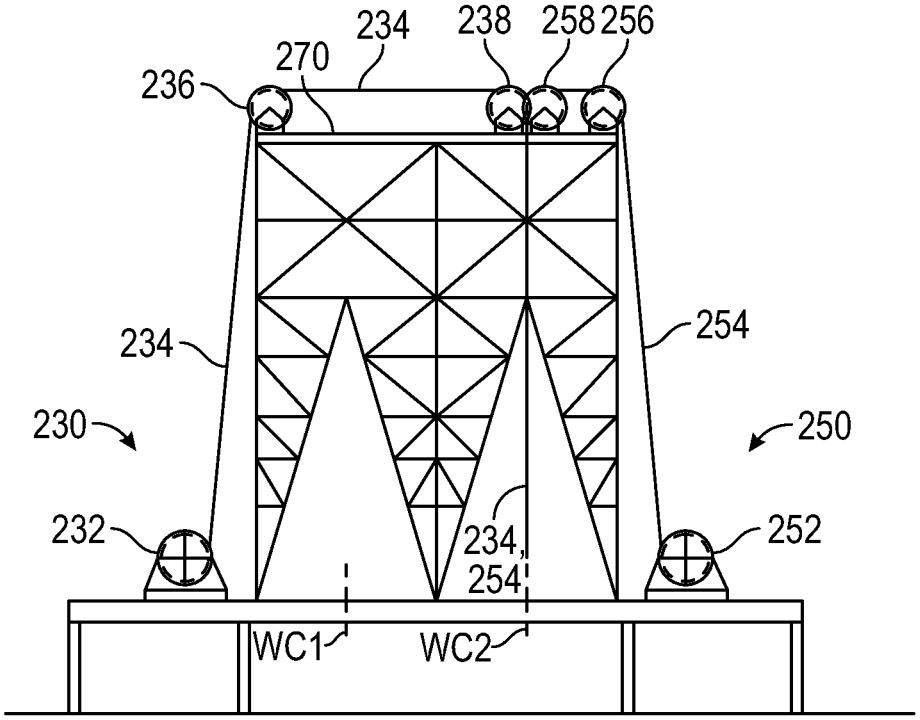
FIG. 8 is the moveable hoisting system of FIG. 6 wherein the hoisting systems are positioned over the same second well center.

Referring now to FIG. 8, the first moveable sheave 238 is moved along the track 270 from the position shown in FIG. 6 to a position adjacent the second moveable sheave 258. Or, in other embodiments, both of the moveable sheaves 238, 258 are moved from the positions of FIG. 7 to the positions of FIG. 8. The sheave 238 is thus moved laterally relative to the fixed sheaves 236, 256 and the well centers WC1, WC2. In these manners, both hoisting lines 234, 254 can be coupled to the equipment 180 over the well center WC2 to increase the overall hoisting capacity of the system 200 by the addition of the first hoisting system 230 to the second hoisting system 250.

Thus, using the drilling system 200, two hoisting systems 230, 250 can be used over respective well centers WC1, WC2 simultaneously, or the dual hoisting assembly 230, 250 can be doubled up over the same well center to increase the hoisting capacity on well equipment 180 as shown in FIGS. 6 and 7. Furthermore, the hoisting machines 232, 252 can be located on different or opposing sides of the derrick 214. In the drilling system 100, the hoisting machines 132, 152 are located on the same side of the derrick 114. In the drilling system 200, the hoisting machines are located on separate sides of the derrick 214.

It is understood that in other embodiments, the drilling system 200 includes a single hoisting system 230 or 250, with a single moveable sheave or set of sheaves 236 or 256. In such embodiments, either the hoisting system 230 or the hoisting system 250 is configured to move its respective moveable sheave 238, 258 to either well center WC1, WC2. In further embodiments, the drilling system 200 includes more than two hoisting systems for moving more than two moveable sheaves or set of sheaves to various positions over two or more well centers.

Figure 9:
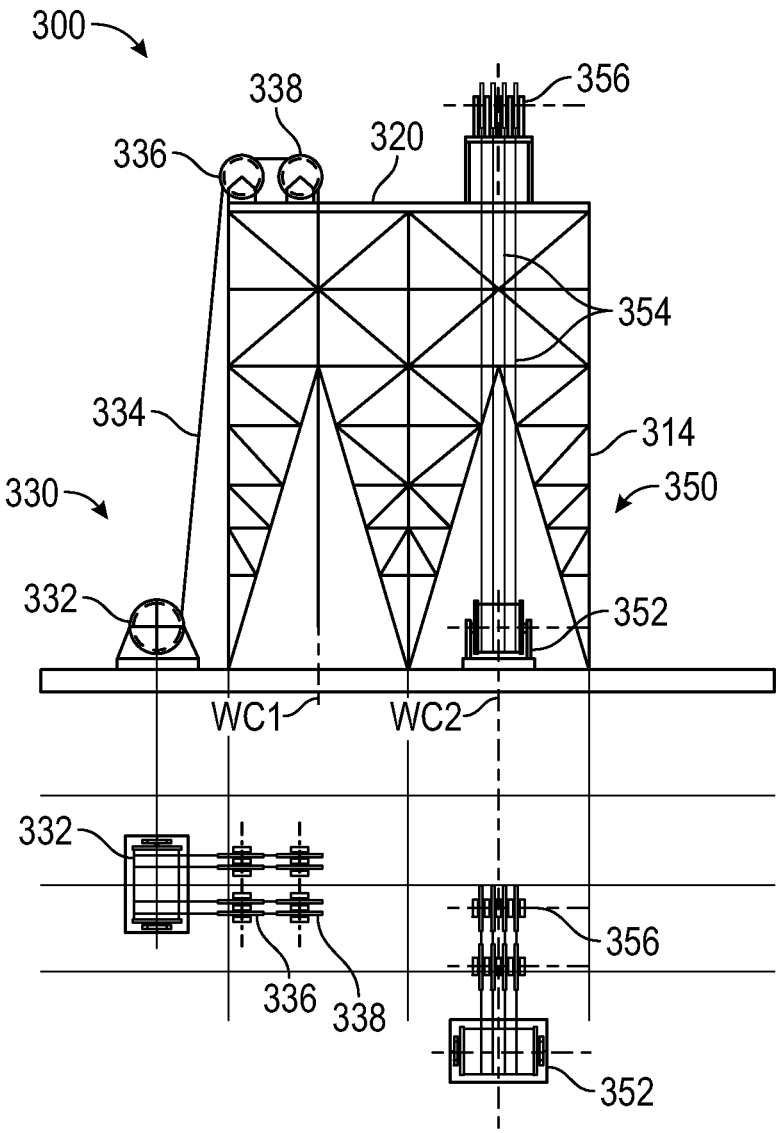
FIG. 9 is a schematic view of still another embodiment of a moveable hoisting system in accordance with principles disclosed herein, wherein one hoisting system is moveable between more than one well center and another hoisting system is fixed over one of the well centers.

Referring now to FIG. 9, a drilling system 300 includes similar features as the drilling systems 100, 200, with similar reference numerals, except where differences are noted below. A first hoisting system 330 includes a first fixed sheave or set of sheaves 336 and a first moveable sheave or set of sheaves 338. The moveable sheave 338 is moveable along a track 370 and powered as described above, to move the sheave 338 and a first hoisting line 334 over the well center WC1. The second hoisting system 350 includes only fixed sheaves 356, for moving hoisting lines 354 with a hoisting machine 352, over the well center WC2. Consequently, the second hoisting system 350 is committed to the well center WC2. The first hoisting system 330 is moveable such that it can separately hoist over the well center WC1, or be moved to hoisting in conjunction with the second hoisting system 350 over the well center WC2. The moveable sheave 338 is moveable laterally relative to the fixed sheaves and the well centers WC1, WC2. Further, as shown in FIG. 9, the hoisting machines 332, 352 are located on different, but not opposing sides of a derrick 314. Thus, the hoisting machines can be positioned at various combinations of locations about the derrick in the drilling systems 100, 200, 300. In some embodiments including more than two hoisting systems and well centers, the hoisting systems can be various combinations of moveable and fixed systems to achieve desirable results and hoisting capacities.

Figure 10:
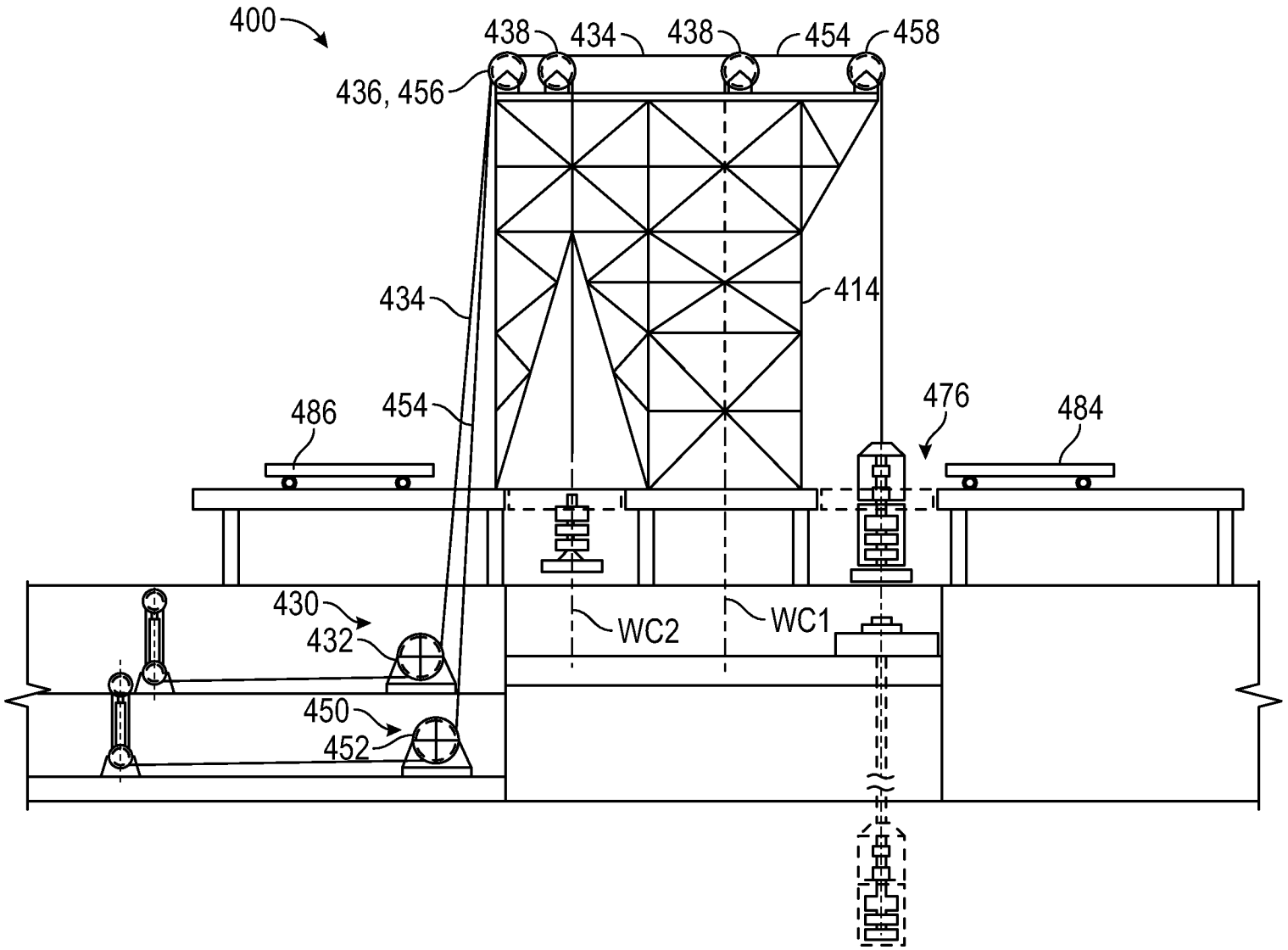
FIG. 10 is a schematic view of another embodiment of a moveable hoisting system incorporating various principles disclosed herein.

Referring to FIG. 10, various teachings and principles as disclosed above are incorporated or combined into a drilling or well system 400. The system 400 includes a first hoisting system 430 having a hoisting line 434, fixed sheaves 436, and moveable sheaves 438. The system 400 includes a second hoisting system 450 having a hoisting line 454, fixed sheaves 456, and moveable sheaves 458. A derrick structure 414 may be a hybrid structure including a cantilevered portion similar to the cantilevered structure of FIGS. 2-5, disposed over well centers WC1, WC2. The moveable sheaves 438, 458 are operable as described above to move laterally and position the hoisting lines 434, 454 variously over the well centers WC1, WC2 or a riser or blowout preventer deployment center 476. After the moveable sheaves 438, 458 are driven to laterally move the hoisting lines 434, 454 to various operating positions, hoisting machines 432, 452 are engaged to axially or longitudinally move the hoisting lines 434, 454 to lift, pull, or let out the hoisting lines 434, 454. The system 400 may also include a riser catwalk 484, a pipe catwalk 486, and other well or rig equipment.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A hoisting system comprising:

a well support structure;

a first hoisting machine disposed on a first side of the well support structure and including a first hoisting line;

a first fixed sheave coupled to the well support structure;

a first moveable sheave coupled to the well support structure, the first moveable sheave slideable along the well support structure to move the first hoisting line relative to the first fixed sheave and a well center;

a second hoisting machine disposed on the first side of the well support structure and including a second hoisting line;

a second fixed sheave coupled to the well support structure; and a second moveable sheave coupled to the well support structure, the second moveable sheave slideable on the well support structure to move the second hoisting line relative to the second fixed sheave and the well center.

2. The hoisting system of claim 1, wherein the well support structure comprises a cantilevered well support structure configured to position the first hoisting line, the second hoisting line, or both, external to the well support structure and over the well center.

3. The hoisting system of claim 1, wherein the first and second moveable sheaves are slideable to position the first hoisting line over the well center while the second hoisting line is positioned over a second well center.

4. The hoisting system of claim 1, wherein the first and second moveable sheaves are slideable to position the first hoisting line over the well center while the second hoisting line is positioned over the well center.

5. The hoisting system of claim 4, wherein the first and second moveable sheaves are coaxial with one another while located to position both the first and second hoisting lines over the well center.

6. The hoisting system of claim 1, wherein the first and second moveable sheaves are moveable to position the first hoisting line over a second well center while the second hoisting line is positioned over the second well center.

7. The hoisting system of claim 1, further comprising a track coupled between the well support structure and the first moveable sheave and a drive mechanism to drive the first moveable sheave along the track.

8. The hoisting system of claim 7, wherein the drive mechanism comprises a motor.

9. The hoisting system of claim 1, wherein the first movable sheave and the second movable sheave are slideable along a lateral axis, the first movable sheave comprises a first axis of rotation, the second movable sheave comprises a second axis of rotation, the first axis of rotation and the second axis of rotation are orthogonal to the lateral axis, and the first axis of rotation and the second axis of rotation are aligned with one another to be coaxial when the first movable sheave and the second movable sheave are located to position both the first and second hoisting lines over the well center.

10. The hoisting system of claim 1, wherein the well center is positioned on a second side of the well support structure opposite the first side of the well support structure, and the well support structure comprises a cantilevered well support structure configured to position the first hoisting line, the second hoisting line, or both external to the well support structure and over the well center.

11. The hoisting system of claim 10, wherein the first and second moveable sheaves overlap one another along a lateral axis that extends from the first side to the second side of the well support structure while the first and second moveable sheaves are located to position both the first and second hoisting lines external to the well support structure and over the well center.

12. The hoisting system of claim 1, wherein the first movable sheave and the second movable sheave are slideable along a first axis and are positioned at different locations along a second axis that is orthogonal to the first axis to enable the first movable sheave and the second movable sheave to be slideable to overlap one another along the first axis.

13. The hoisting system of claim 1, wherein the second hoisting line extends laterally across the first movable sheave while the first hoisting line is positioned over a second well center and while the second hoisting line is positioned over the well center.

14. The hoisting system of claim 1, wherein the first side of the well support structure is located at a first position along a lateral axis, the well center is located at a second position along the lateral axis, a second well center is located at a third position along the lateral axis between the first position and the second position, and the second hoisting line extends along the lateral axis and laterally across the first movable sheave while the first hoisting line is positioned over the second well center and while the second hoisting line is positioned over the well center.

15. A method of moving a first hoisting line and a second hoisting line comprising:

disposing a first hoisting machine and a second hoisting machine on a first side of a well support structure;

passing the first hoisting line from the first hoisting machine over a first fixed sheave coupled to the well support structure and over a first moveable sheave coupled to the well support structure;

sliding the first moveable sheave along the well support structure to laterally move the first hoisting line relative to the first fixed sheave and a well center;

passing the second hoisting line from the second hoisting machine over a second fixed sheave coupled to the well support structure and over a second moveable sheave coupled to the well support structure; and sliding the second moveable sheave along the well support structure to laterally move the second hoisting line relative to the second fixed sheave and the well center.

16. The method of claim 15, further comprising engaging the first hoisting machine to axially move the first hoisting line over the first fixed sheave and the first moveable sheave.

17. The method of claim 15, further comprising sliding the first moveable sheave to position the first hoisting line over the well center, and sliding the second moveable sheave to position the second hoisting line over a second well center while the first hoisting line is positioned over the well center.

18. The method of claim 15, further comprising sliding the first moveable sheave to position the first hoisting line over the well center, and sliding the second moveable sheave to position the second hoisting line over the well center while the first hoisting line is positioned over the well center.

19. The method of claim 15, further comprising sliding the first moveable sheave to position the first hoisting line over a second well center, and sliding the second moveable sheave to position the second hoisting line over the second well center while the first hoisting line is positioned over the second well center.

20. A hoisting system, comprising:

a well support structure;

a first hoisting machine disposed on a first side of the well support structure and including a first hoisting line;

a first fixed sheave coupled to the well support structure;

a first moveable sheave coupled to the well support structure, the first moveable sheave slideable along the well support structure and relative to the first fixed sheave;

a second hoisting machine disposed on the first side of the well support structure and including a second hoisting line;

a second fixed sheave coupled to the well support structure; and a second moveable sheave coupled to the well support structure, the second moveable sheave slideable on the well support structure and relative to the second fixed sheave;

wherein the first and second moveable sheaves are configured to move between a first configuration to position one of the first and second hoisting lines over a first well center and to position another one of the first and second hoisting lines over a second well center, a second configuration to position both of the first and second hoisting lines over the first well center, and a third configuration to position both of the first and second hoisting lines over the second well center;

wherein the first and second movable sheaves are coaxial with one another while in the second configuration and while in the third configuration.

* * * * *